US009186801B1

(12) United States Patent
Steigerwalt

(10) Patent No.: US 9,186,801 B1
(45) Date of Patent: Nov. 17, 2015

(54) FOLDING TOOL

(71) Applicant: Kenneth A. Steigerwalt, Orangeville, PA (US)

(72) Inventor: Kenneth A. Steigerwalt, Orangeville, PA (US)

( * ) Notice: Subject to any disclaimer, the term of this patent is extended or adjusted under 35 U.S.C. 154(b) by 124 days.

(21) Appl. No.: 14/104,263

(22) Filed: Dec. 12, 2013

Related U.S. Application Data

(60) Provisional application No. 61/750,407, filed on Jan. 9, 2013.

(51) Int. Cl.
*B26B 1/10* (2006.01)
*B26B 1/04* (2006.01)

(52) U.S. Cl.
CPC ..... *B26B 1/04* (2013.01)

(58) Field of Classification Search
USPC ..... 30/156–161, 155
See application file for complete search history.

(56) References Cited

U.S. PATENT DOCUMENTS

| | | | | |
|---|---|---|---|---|
| 728,416 | A | 5/1903 | Rowland | |
| 924,070 | A * | 6/1909 | Holman | 30/161 |
| 2,924,879 | A * | 2/1960 | Kraus, Jr. | 30/151 |
| 5,647,129 | A * | 7/1997 | Stamper | 30/139 |
| 5,781,998 | A * | 7/1998 | Stamper | 30/139 |
| 6,170,158 | B1 * | 1/2001 | Daily | 30/161 |
| 6,694,620 | B2 * | 2/2004 | Kanzawa | 30/161 |
| 7,533,466 | B2 | 5/2009 | Steigerwalt | |

* cited by examiner

*Primary Examiner* — Omar Flores Sanchez
(74) *Attorney, Agent, or Firm* — Donald J. Ersler

(57) ABSTRACT

A folding tool includes a handle, a tool member and a tool member cover. The handle includes a first handle half and a second handle half. One end of the tool member is pivotally retained by the handle. A cover pivot pin is retained in the other end of the first and second handle halves. The cover pivot pin is inserted through a longitudinal slot formed through one end of the tool member cover. A substantially D-shaped slot is formed in the other end of the first or second handle halves. A guide pin extends from the tool member cover. The guide pin is sized to slide freely in the substantially D-shaped slot. The tool member cover is pivoted against the tool member in an open position and pivoted away from the handle to protect the tool member in a closed position.

12 Claims, 6 Drawing Sheets

FOLDING TOOL

CROSS-REFERENCES TO RELATED APPLICATIONS

This is a nonprovisional patent application taking priority from provisional application No. 61/750,407 filed on Jan. 9, 2013.

BACKGROUND OF THE INVENTION

1. Field of the Invention

The present invention relates generally to tools and more specifically to a folding tool, which includes a normal length handle.

2. Discussion of the Prior Art

Folding tools are well known in the art. However, some prior art folding tools have extra long handles to protect a cutting edge of an extra long tool member in a closed orientation. It is advantageous to have a folding tool to reduce storage space and protect the cutting edge of the extra long tool member. However, having an extra long handle to hold makes using the folding tool more difficult to use. U.S. Pat. No. 728,416 to Howland discloses a hunting knife. U.S. Pat. No. 7,533,466 to Steigerwalt (Steigerwalt) discloses a folding tool with lock. However, the Steigerwalt lock is an expensive portion of the folding tool.

Accordingly, there is a clearly felt need in the art for a folding tool, which includes a normal length handle, and a tool member cover, which locks a tool member in an open position and protects a cutting edge of the tool member in a closed position.

SUMMARY OF THE INVENTION

The present invention provides a folding tool, which includes a tool member cover that locks the tool member in an open position and protects a cutting edge of the tool member in a closed position. The folding tool includes a handle, a tool member and the tool member cover. The handle includes a first handle half and a second handle half. One end of the tool member is pivotally retained between one end of the first and second handle halves with a pivot pin. The tool member includes a cutting edge formed along substantially all of a portion of a length thereof. A tool member slot is formed along substantially all of an inner length of the tool member cover to receive a portion of the cutting edge of the tool member.

A cover pivot pin is retained in the other end of the first and second handle halves. The tool member cover includes a longitudinal slot formed through one end and a finger projection extending from the other end thereof. The longitudinal slot is pivotally and slidably engaged with the cover pivot pin. A substantially D-shaped slot is formed in the other end of at least one of the first or second handle halves. A guide pin extends from the tool member cover, preferably in line with the tool member slot. The guide pin is sized to slide freely in the substantially D-shaped slot. The cover pivot pin is preferably retained in line with a straight portion of the substantially D-shaped slot.

The tool member cover is pivoted against the one end of the tool member to lock the tool member in an open position. The tool member cover is pivoted outward away from the tool member. Then, the tool member cover is extended axially away from the handle to receive the tool member. Next, the tool member is folded into the tool member cover. Finally, the tool member cover is then pushed toward the handle to retain the tool member and protect the cutting edge in a closed position.

Accordingly, it is an object of the present invention to provide a folding tool, which includes a normal length handle.

Finally, it is another object of the present invention to provide a folding tool, which includes a tool member cover that locks the tool member in an open position and protects a cutting edge of the tool member in a closed position.

These and additional objects, advantages, features and benefits of the present invention will become apparent from the following specification.

DETAILED DESCRIPTION OF THE PREFERRED EMBODIMENTS

Figure 1:
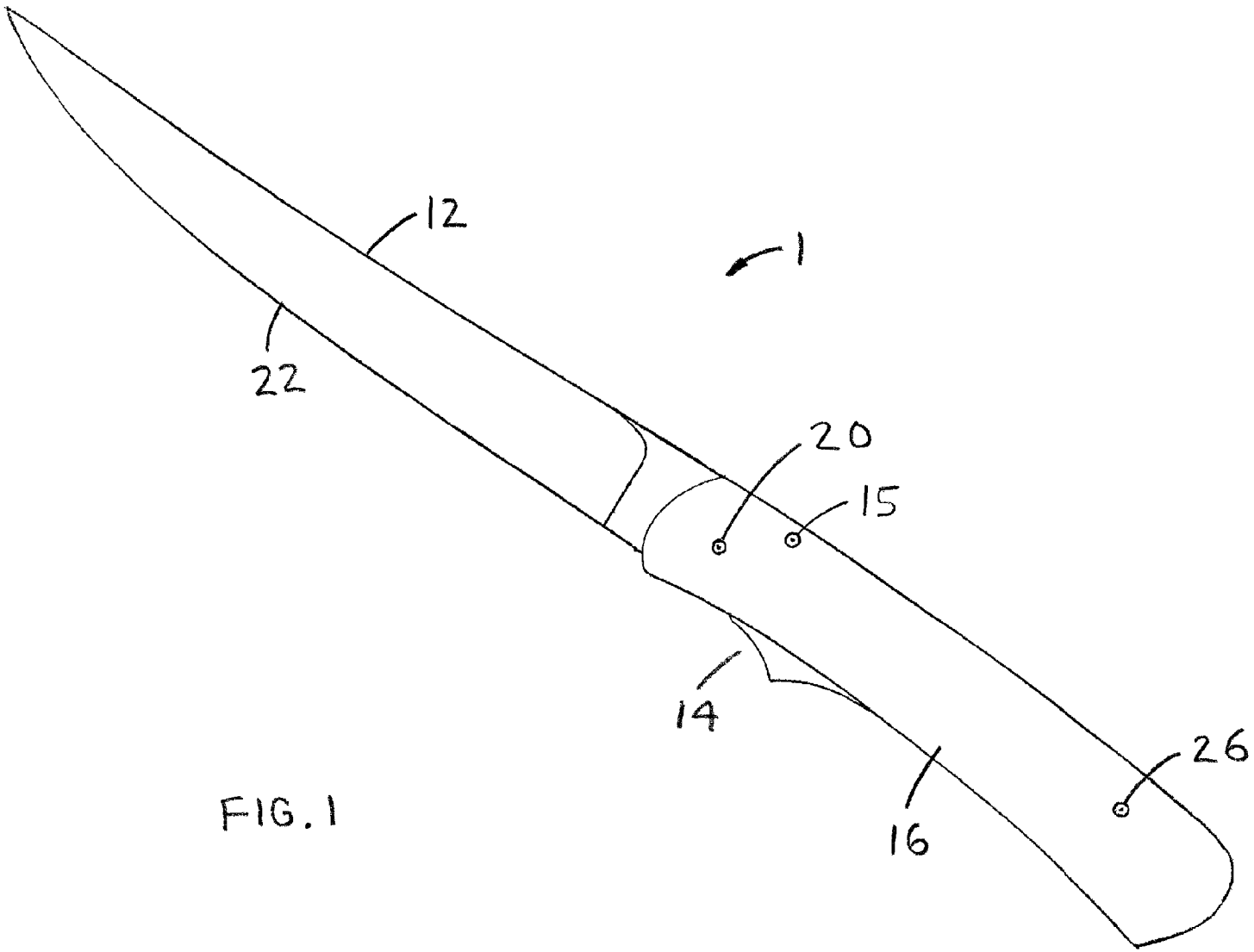
FIG. 1 is a side view of a folding tool in an open position in accordance with the present invention.
Figure 2:
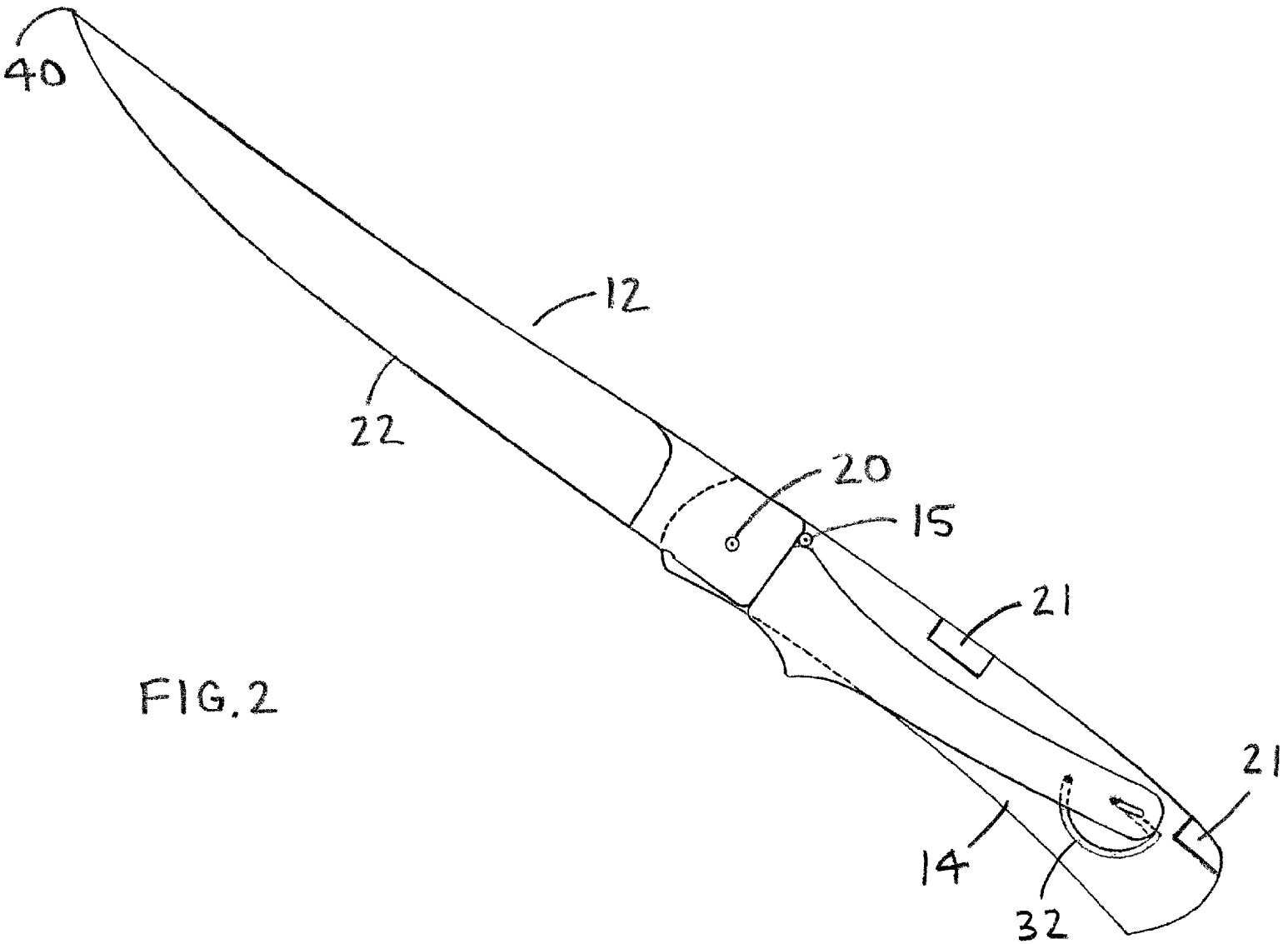
FIG. 2 is a side view of a folding tool in an open position with a first handle half removed in accordance with the present invention.
Figure 3:
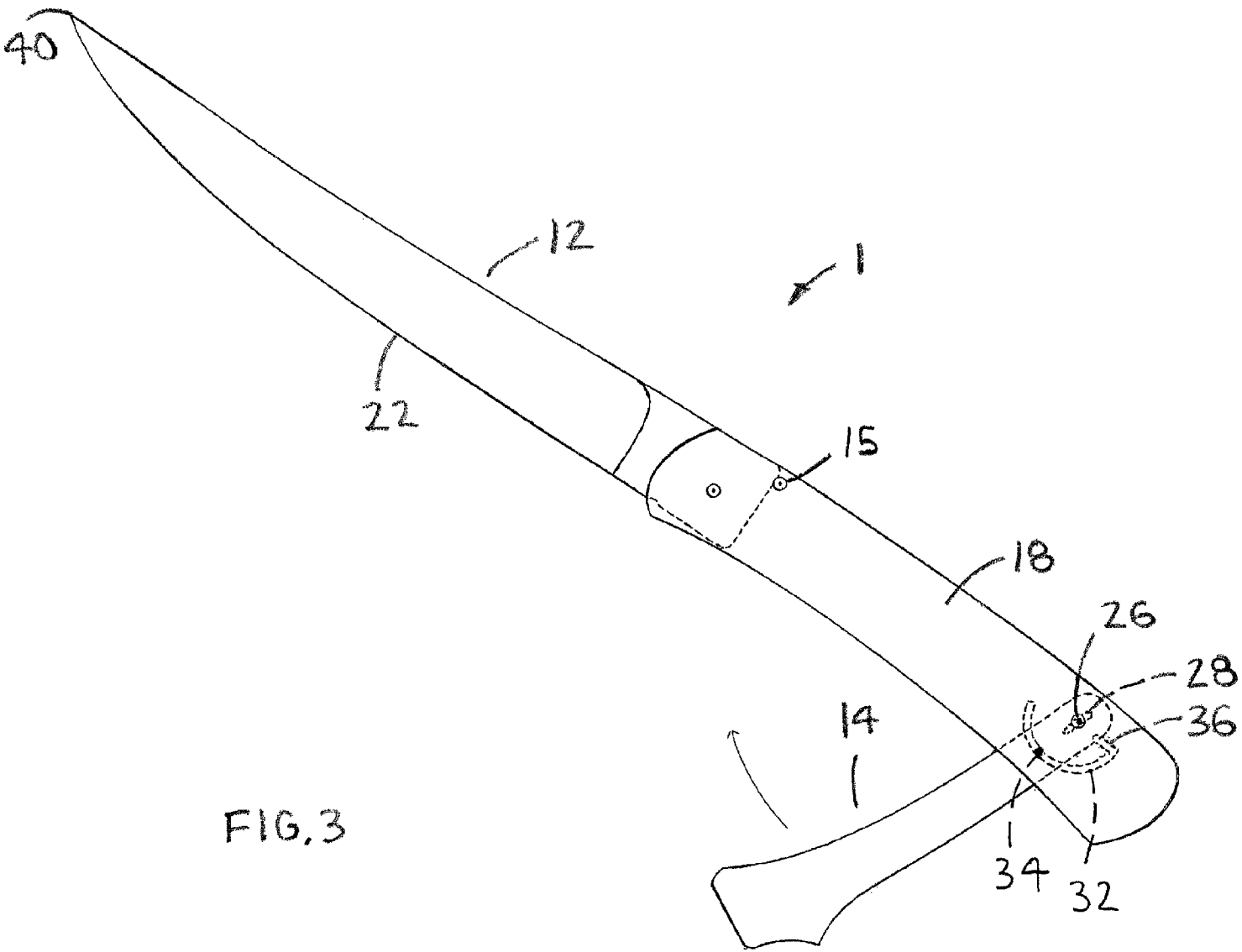
FIG. 3 is a side view of a folding tool in an open position with a first handle half removed and a tool member cover partially rotated toward one end of a tool member in accordance with the present invention.
Figure 4:
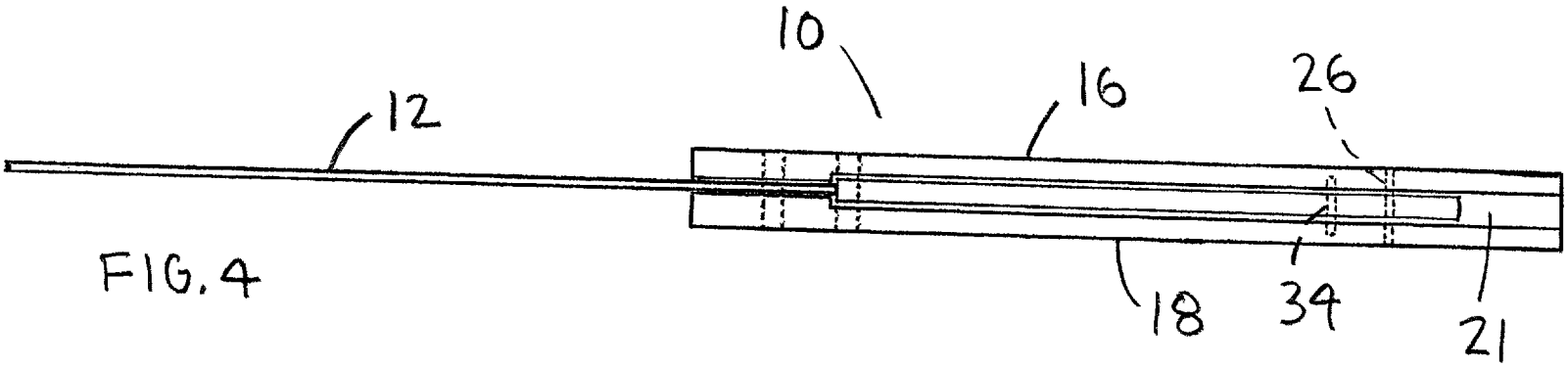
FIG. 4 is a bottom view of a folding tool in an open position in accordance with the present invention.
Figure 5:
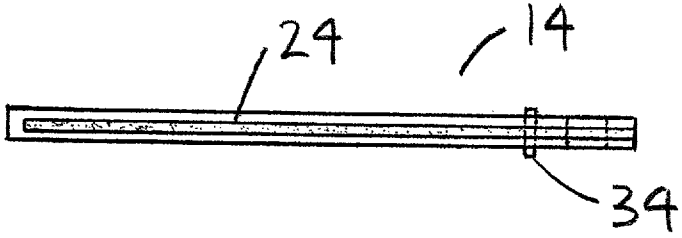
FIG. 5 is a bottom view of a tool member cover of a folding tool in accordance with the present invention.
Figure 6:
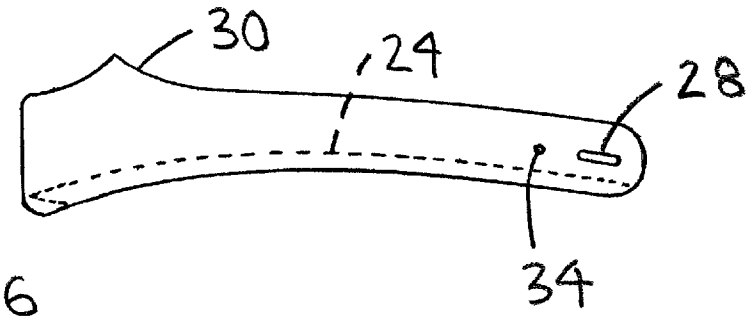
FIG. 6 is a side view of a tool member cover of a folding tool in accordance with the present invention.

With reference now to the drawings, and particularly to FIG. 1, there is shown a side view of a folding tool 1. With reference to FIGS. 2-6, the folding tool 1 includes a handle 10, a tool member 12 and a tool member cover 14. The handle 10 includes a first handle half 16 and a second handle half 18. One end of the tool member 12 is pivotally retained between one end of the first and second handle halves 16, 18 with a pivot pin 20. Preferably, at least one spacer 21 extends from an inside surface of at least one of the first and second handle halves. The tool member 12 includes a cutting edge 22 formed along substantially all of a length thereof. A stop pin 15 is inserted through at least one of the first and second handle halves 16, 18 to stop rotation of the tool member 12 and the tool member cover 14, when the tool member 12 is in an open position. A tool member slot 24 is formed along substantially all of an inner length of the pivoting tool member cover 14 to receive a portion of the cutting edge 22 of the tool member 12.

A cover pivot pin 26 is retained in the other end of the first and second handle halves 16, 18. The tool member cover 14 includes a longitudinal slot 28 formed through one end and a finger projection 30 extending from the other end thereof. The longitudinal slot 28 is pivotally and slidably engaged with the cover pivot pin 26. A substantially D-shaped slot 32 is formed in the other end of at least one of the first or second handle halves 16, 18. A guide pin extends 34 from at least one side of the tool member cover 14, preferably in line with the cutting edge slot 28. The guide pin 34 is sized to slide freely in the substantially D-shaped slot 32. The cover pivot pin 26 is preferably retained in line with a straight portion 36 of the substantially D-shaped slot 32.

Figure 7:
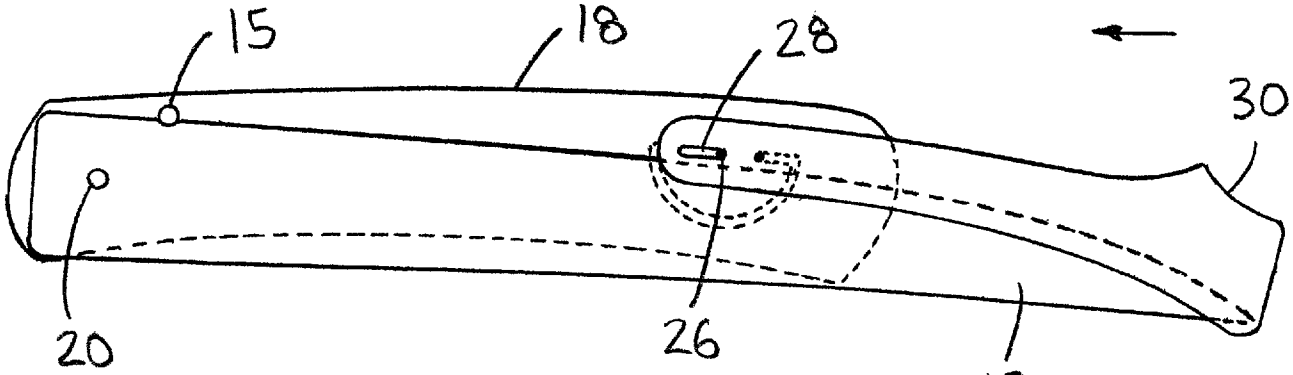
FIG. 7 is a side view of a folding tool in a closed position with a first handle half removed and a tool member cover extended from a handle to receive a tool member in accordance with the present invention.
Figure 8:
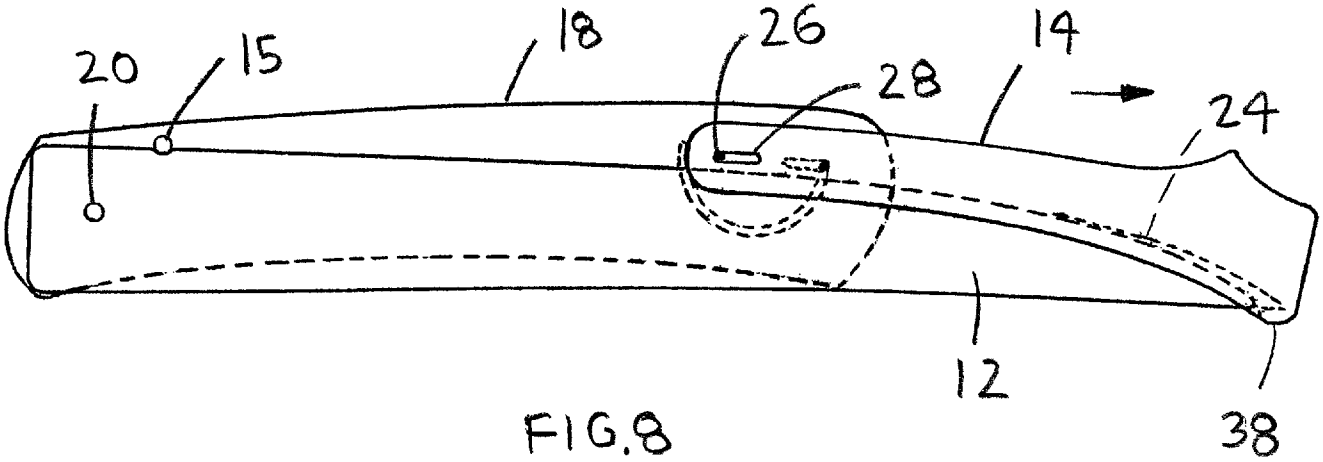
FIG. 8 is a side view of a folding tool in a closed position with a first handle half removed and a tool member cover retracted toward a handle to lock a tool member in a closed position in accordance with the present invention.
Figure 9:
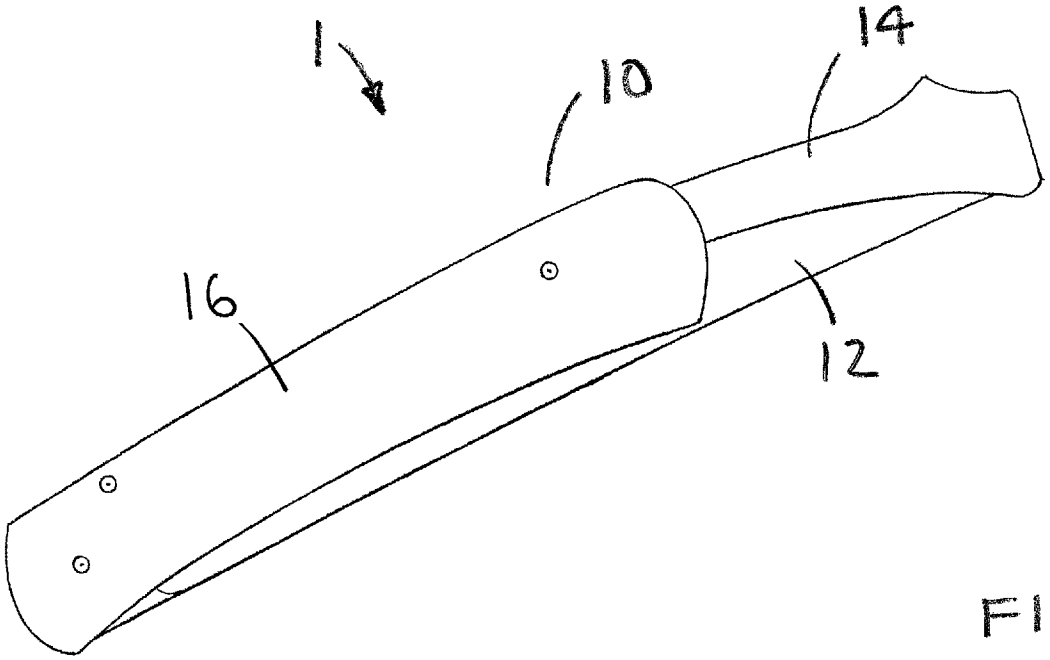
FIG. 9 is a side view of a folding tool in a closed position in accordance with the present invention.

The tool member cover 14 is pivoted against the one end of the tool member 12 to lock the tool member 12 in an open position. With reference to FIGS. 7-9, the tool member cover 14 is pivoted outward away from the tool member 12. Then, the tool member cover 14 is extended axially away from the handle 10 (second handle half 18) to receive the tool member 12. Next, the tool member 12 is folded into the tool member cover 14. A tool member tip lip 38 is formed on an end of the tool member slot 24 to lock a tip 40 of the tool member 12 in a closed position. Finally, the tool member cover 14 is then pushed toward the handle 10 (second handle half 18) to retain the tip 40 of the tool member 12 and protect the cutting edge 22 in the closed position.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A folding tool comprising:

a handle includes a first handle half and a second handle half;

a tool member includes a cutting edge, one end of said tool member is pivotally retained between said first and second handle halves at one end thereof; and a tool member cover having one end, said one end of said tool member cover is pivotally retained relative to the other end of said handle, wherein said tool member cover is pivoted against said one end of said tool member to lock said tool member in an open position, said tool member cover is pivoted away from said tool member, said tool member is closed against said tool member cover in a closed position;

a longitudinal slot is formed through said one end of said tool member cover, a cover pivot pin is inserted through said longitudinal slot and at least one of said first and second handle halves; and a guide pin is inserted through said tool member cover adjacent said longitudinal slot, a substantially D-shaped slot is formed in at least one of said first and second handle halves, said substantially D-shaped slot is sized to receive said guide pin.

2. The folding tool of claim 1 wherein:

a tool member slot is formed along substantially all of an inner length of said tool member cover to receive a portion of said cutting edge.

3. The folding tool of claim 2 wherein:

a tool member tip lip is formed on an end of said tool member slot to lock a tip of said tool member in the closed position.

4. The folding tool of claim 2 wherein:

a finger projection extends from the other end of said tool member cover.

5. The folding tool of claim 1, further comprising:

a stop pin is retained in at least one of said first and second handle halves, wherein said stop pin contacts said one end of said tool member in the open position.

6. The folding tool of claim 1 wherein:

at least one spacer extends from an inner surface of at least one of said first and second handle halves.

7. A folding tool comprising:

a handle includes a first handle half and a second handle half;

a tool member includes a cutting edge, one end of said tool member is pivotally retained between said first and second handle halves at one end thereof; and a tool member cover having one end, said one end of said tool member cover is pivotally and slidably retained relative to the other end of said handle, wherein said tool member cover is pivoted and slid against said one end of said tool member to lock said tool member in an open position, said tool member cover is pivoted and slid away from said tool member, said tool member is closed against said tool member cover in a closed position;

a longitudinal slot is formed through said one end of said tool member cover, a cover pivot pin is inserted through said longitudinal slot and at least one of said first and second handle halves; and a guide pin is inserted through said tool member cover adjacent said longitudinal slot, a substantially D-shaped slot is formed in at least one of said first and second handle halves, said substantially D-shaped slot is sized to receive said guide pin.

8. The folding tool of claim 7 wherein:

a tool member slot is formed along substantially all of an inner length of said tool member cover to receive a portion of said cutting edge.

9. The folding tool of claim 8 wherein:

a tool member tip lip is formed on an end of said tool member slot to lock a tip of said tool member in the closed position.

10. The folding tool of claim 7 wherein:

a finger projection extends from the other end of said tool member cover.

11. The folding tool of claim 7, further comprising:

a stop pin is retained in at least one of said first and second handle halves, wherein said stop pin contacts said one end of said tool member in the open position.

12. The folding tool of claim 7 wherein:

at least one spacer extends from an inner surface of at least one of said first and second handle halves.

* * * * *